United States Patent [19]

Lipson

[11] Patent Number: 4,898,758

[45] Date of Patent: Feb. 6, 1990

[54] PAINT MASK

[76] Inventor: Ronald B. Lipson, 6085 Pickwood Dr., West Bloomfield, Mich. 48033

[21] Appl. No.: 240,607

[22] Filed: Sep. 6, 1988

[51] Int. Cl.[4] ..... B05C 11/16

[52] U.S. Cl. ..... 428/99; 118/504; 118/505

[58] Field of Search ..... 428/99; 118/504, 505

[56] References Cited

U.S. PATENT DOCUMENTS

| | | | |
|---|---|---|---|
| 2,538,743 | 1/1951 | Alston | 118/504 |
| 3,320,811 | 5/1967 | Johnson et al. | 118/505 X |
| 4,327,663 | 5/1982 | Izzo | 118/505 |

*Primary Examiner*—Alexander S. Thomas
*Attorney, Agent, or Firm*—Dykema Gossett

[57] ABSTRACT

A paint mask for a three-dimensional insignia plate upon a vehicle body comprises an integral molded thin hollow part of plastic material having a three-dimensional shape corresponding to the insignia plate. The portion of the hollow part defines an opening to receive the insignia plate. A plurality of spaced flexible anchor flanges extend radially inward to underlie and retainingly engage the insignia plate. A paint or other mask protects the insignia plate or other part from paint or other material sprayed on a body adjacent the molded insignia plate.

2 Claims, 1 Drawing Sheet

PAINT MASK

FIELD OF INVENTION

This invention relates to a paint mask for protecting a three-dimensional insignia plate mounted upon a vehicle body.

BACKGROUND OF THE INVENTION

Plastic and steel stamped insignia plate which designate the type or model of a particle motor vehicle are often fastened to the panel of a motor vehicle with double-backed adhesive tape that follows the contour of the insignia. This tape is normally made a part of the insignia on the back thereof. When it is desired to spray paint or otherwise paint the panel of a vehicle about the insignia plate, it is common practice to use masking tape so that paint does not come in contact with the insignia plate. However, the tape often covers some areas of the panels adjacent the insignia plate, thereby making the job uneven and necessitating repainting or touch-up. This is tedious, time-consuming and costly. It is difficult to cover the insignia plate in such a way that the paint is uniform immediately adjacent the insignia plate.

Therefore, a need exists for a paint mask which shields the insignia plate of motor vehicles which is inexpensive to make, due to the large number of insignia plates which must be provided, and easy to use. There is needed a paint mask which protects insignia plates from a spray paint for painting the vehicle panels such that the paint is evenly applied to the panel adjacent the insignia plate.

Insignia masks have been made which are difficult to adhere to the insignia and accidentally fall off. Some masks are too large, do not fit properly and fall off.

THE PRIOR ART

Masking devices are shown in one or more of the following United States patents:

| U.S. Pat. No. | Issued To | Date |
|---|---|---|
| 2,363,843 | Duggan | November 28, 1944 |
| 2,363,845 | Duggan | November 28, 1944 |
| 2,363,846 | Duggan | November 28, 1944 |
| 2,547,674 | Tobey | April 3, 1951 |
| 2,726,634 | Horner | December 13, 1955 |
| 2,959,152 | Byers et al. | November 8, 1960 |
| 3,225,387 | Angilello et al. | December 28, 1965 |

SUMMARY OF THE INVENTION

An important feature of the present invention is to provide a paint mask for a vehicle insignia plate, and wherein the mask is vacuum-formed, for illustration, and easy to make.

A further feature is to provide a paint mask which eliminates the use of adhesive to secure the mask, is easy to assemble and disassemble upon the insignia plate, and which will not come off accidentally.

Another feature is to provide a paint mask for protecting the exposed surfaces of a vehicle insignia plate which projects outwardly from the surface of the vehicle body which comprises an integral preformed thin-walled hollow plastic pat having an inner surface in obverse form to the insignia plate for abutting engagement thereover. The outer surface is a slightly enlarged replica of the outer surface of the insignia plate, wherein the portion of the plastic part defining its opening seals the plate immediately adjacent the support panel and adjacent the perimeter of the insignia plate, and which has arranged around its opening a series of spaced, coplanar inwardly-directed anchor flanges which engage under peripheral portions of the insignia plate.

These and other features and objects will be seen in the following detailed description in connection with the accompanying drawing.

THE DRAWING

It is to be understood that the above drawing illustrates merely a preferred embodiment of the invention and that other embodiments are contemplated within the scope of the claims hereafter set forth.

DETAILED DESCRIPTION OF AN EMBODIMENT OF THE INVENTION

Figure 1:
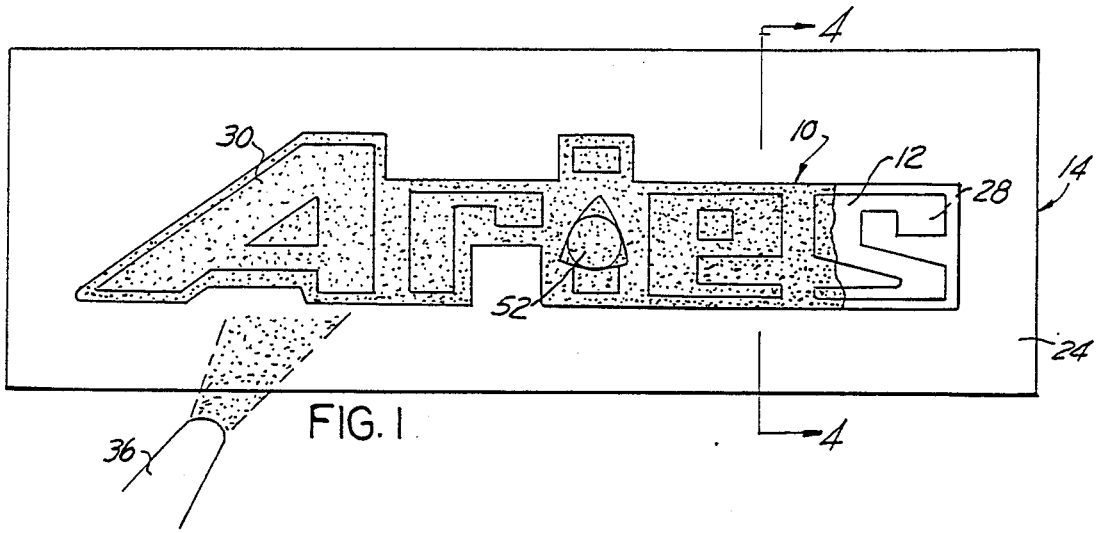
FIG. 1 is a side elevational view of a paint mask, partially broken away, positioned over a mounted insignia plate to be protected from a paint spray.
Figure 4:
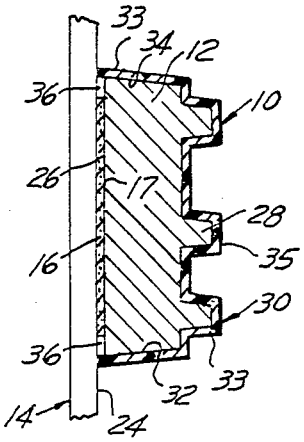
FIG. 4 is an enlarged cross-sectional view of a portion of the mask taken in the direction of arrows 4—4 of FIG. 1.

Referring to FIG. 1, a paint mask 10 is shown positioned over a steel-stamped or plastic insignia plate 12. Said plate comprises an ornamental configuration and is mounted to the side panel or body 14 of a motor vehicle by a continuous strip 16 of double-backed adhesive tape or other pressure-sensitive adhesive which extends along the bottom surface 17 of the insignia plate, FIG. 4.

The insignia plate 12 includes a base portion 26 which due to the adhesive strip 16 is spaced outwardly from the outer surface 24 of body 14 and forms a base for the lettering portion 28 of insignia 12 which projects outwardly from sid portion. The lettering portion 28 conveys information about the type and model of the particular motor vehicle to which the insignia plate 12 is attached. Said base portion and the lettering portion presents an outwardly convex surface or ornamental design which may take the form of many different types of alphanumeric information, figures or emblems to thereby identify a motor vehicle.

The paint mask 10 includes an integral preformed thin hollow plastic part 30. Said part includes a continuous outer side 33 and top portion 35. The plastic part 30 is preferably formed by a vacuum-forming technique such that its inner surface 32 is in obverse or complementary form to the ornamental configuration of both the base and lettering portions 26 and 28 of insignia plate 12. When the plastic part 30 is positioned over the insignia plate, its inner surface 32 is in abutting engagement with the base and lettering portions 26 and 28 of the insignia plate 12 at their outer exposed surfaces. The bottom portions 34 of the outer side walls 33 define the opening of the hollow plastic part 30. The bottom portions 34 of the outer side wall 33 seals the insignia plate 12 immediately adjacent its outer perimeter and immediately adjacent body wall 14.

The mask outer side walls 34 at said opening include a series of spaced inwardly-directed coplanar anchor flanges 36. Said flanges extend under spaced peripheral portions of the insignia base 26 and are removably interlocked therewith, FIG. 4. The insignia plate is protected about its outer periphery from a paint sprayed on the body wall 14 at its outer surface 24 as shown in phantom in FIG. 1 by a paint-spraying nozzle 36. When the plastic part 30 is positioned, in FIGS. 1 and 4, portions 34 of the plastic part abuttingly engage the wall 14 at its outer surface 24 and the base portion 26 at its exposed surfaces.

The plastic part 30 is formed from a plastic such as as polystyrene or polypropylene, for illustration, which provides the necessary lightness and rigidity required. Styrene does not dissolve by most paints applied thereon and is relatively inexpensive. The plastic part 30 has a uniform wall thickness between 0.1 to 1 millimeter to allow the paint spray to cover the outer surface 24 of the wall 14 as close as possible to the base portion 26 of insignia plate 12.

The outer side walls 33 of the plastic part 30 are thin enough so as to enable the paint to be designated on the wall 24 a distance from the base portion 26 of the insignia plate 12 equal to the thickness of the outer side walls 33. As a result, the paint mask 10 does not create a design but rather protects only the insignia plate 12.

Figure 5:
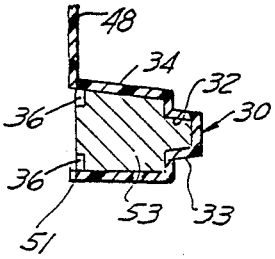
FIG. 5 is a sectional view illustrating molding of the mask.

As shown in FIG. 5, the outer surface of the plastic part 30 is vacuum-molded in a multi-cavity high-temperature epoxy molding die 53 to form a slightly enlarged replica of the outer surface of the base and lettering portions 26 and 28. In use, the plastic part is then placed over insignia plate 12, and its peripheral flanges 36 are snapped under the periphery of the insignia base 26 and is snugly mounted and self-securing thereon.

Figure 2:
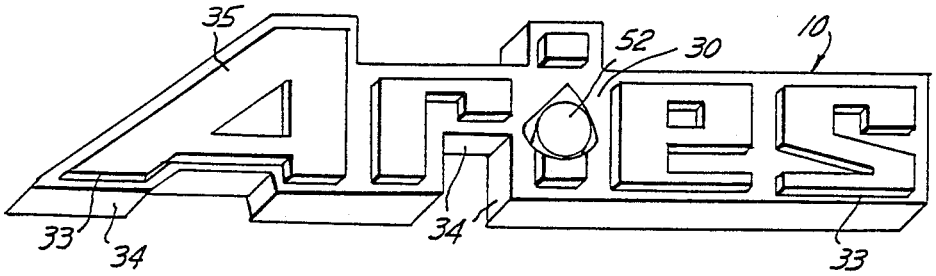
FIG. 2 is a front perspective view of the mask.

The plastic part 30, FIG. 2, is provided with a molded handle projection 52 integrally formed with the plastic part 30 to facilitate disengagement of fingers 36 and removal of the paint mask 10 from insignia plate 12.

Figure 3:
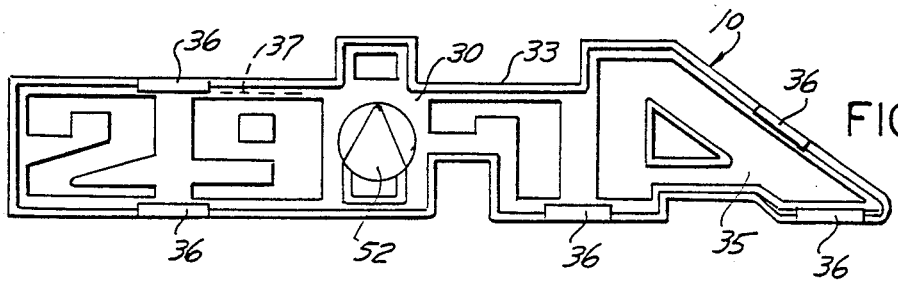
FIG. 3 is a bottom plan view thereof.

As an alternative, the peripheral flanges 36 could be continuous throughout the mask periphery at its opening as at 37, FIG. 3.

One method of making the painting mask for a three-dimensional insignia plate 12 which is mounted upon body part 14 of the vehicle includes the following steps:

Applying a sheet 48 of plastic material, FIG. 5, of a predetermined thickness to a pre-heated multi-cavity high-temperature epoxy mold 53 having a three-dimensional configuration which corresponds to the three-dimensional insignia plate 12.

Vacuum-forming the sheet 48 of said plastic material onto the said mold at a temperature rendering the sheet of plastic material plastic so as to conform to the mold surface. Three-dimensional configuration of the insignia plate 12 is reproduced in the hollow vacuum-formed part 30 upon the plastic sheet 48, at its base, being integral with and merging with the sheet of plastic material 48.

A final step includes transversely severing the molded parts from sheet 48 in a plane closely adjacent and parallel to the molded sheet 48 to define a peripheral planar edge 51 with a series of spaced inturned anchor flanges 36, FIG. 3, in the molded part 30 adjacent its base 34.

The molded part 30 is cooled and separated from the mold, which is a conventional vacuum mold of a high-temperature epoxy, whose operation is not described in detail. The inner surface 32 of the molded part is the obverse form of the insignia plate 12 and is adapted for abutting snug engagement thereover. The outer surface of the molded part 30 is a slightly enlarged replica of the outer surface of the insignia plate. The portion of the plastic part 30 defining its opening is adapted to seal the insignia plate 12 immediately adjacent the vehicle body 14 on which it is mounted and immediately adjacent the perimeter of the insignia plate whereby the insignia plate is protected from painted sprayed on said body adjacent the plastic part. The peripheral flanges 36 are adapted to snap under peripheral portions of the insignia 12.

The method includes the further step of simultaneously vacuum-forming forming into the molded part 30 an outwardly-extending handle 52 to facilitate disengaging the anchor flanges 36 from the insignia and lifting and separating the mask from the insignia plate.

While in the illustrated embodiment the mask has been referred to as a paint mask for an insignia plate for a vehicle, it is contemplated that the mask could be used for other vehicle parts such as tail lights, door handles, moldings and so forth, or for parts for non-automotive devices such as boats, campers, motorcycles, appliances, or paint spray and non-paint applications such as spraying of adhesive.

The present invention eliminates the need for adhesive for anchoring the mask upon an insignia plate. The present invention provides a means for snap-fastening the mask onto the insignia. The present mask provides a snap interlock with the insignia plate and protects against accidental separation of the mask therefrom. The coplanar spaced anchor flanges formed around the opening of the mask are an integral part thereof, whereby the mask is easily removable from the insignia plate. This solves the problem of loose fits because the anchor flanges prevent accidental separation and falling off of the mask. The mask does not need an exact fit with respect to the insignia plate and may be loose since the anchor flanges provide a mechanical interlock for anchoring the present mask to the insignia plate.

Having described my invention, reference should now be had to the following claims:

I claim:

1. A combination paint mask and insignia plate for protecting the exposed surfaces of a three-dimensional vehicle insignia plate mounted on and projecting outwardly from the surface of a vehicle body, the insignia plate having an outer perimeter and a flat under surface, the mask including an integral molded thin hollow part of plastic material wherein the inner surface of said part is in obverse form to the insignia plate for abutting engagement there-over, and wherein the outer surface of said part is a slightly enlarged replica of the outer surface of the insignia plate, and wherein the peripheral edge portion of said part defining the opening of the hollow part seals the insignia plate immediately adjacent the vehicle body and immediately adjacent said outer and inner perimeters;

and a plurality of spaced flexible coplanar anchor flanges upon said peripheral portion extending radially inward, underlying and retainingly engaging said under surface and peripheral portions of said insignia;

said flanges being spaced around said peripheral portion;

said insignia plate having a layer of adhesive material connected to and underlying said insignia plate for anchoring said insignia plate to said body, said adhesive material spacing peripheral portions of said insignia plate from said body, said flanges being deflectable and of such shape and dimension as to be self-securing under and around said insignia plate in the space between said peripheral portions and said body formed by said adhesive material;

whereby the insignia plate is protected from paint sprayed on said body immediately adjacent said plastic part.

2. In the paint mask of claim 1, said anchor flanges being substantially continuous throughout the outer periphery of said mask.

* * * * *